US008708665B2

(12) United States Patent
Stenberg

(10) Patent No.: US 8,708,665 B2
(45) Date of Patent: Apr. 29, 2014

(54) MEMBRANE PUMP OPERATING IN BOTH AUDIBLE AND INAUDIBLE FREQUENCY REGIONS

(75) Inventor: Johan Stenberg, Härnösand (SE)

(73) Assignee: Xavitech AB, Härnösand (SE)

( * ) Notice: Subject to any disclaimer, the term of this patent is extended or adjusted under 35 U.S.C. 154(b) by 339 days.

(21) Appl. No.: 12/990,315

(22) PCT Filed: Mar. 18, 2009

(86) PCT No.: PCT/SE2009/050277

§ 371 (c)(1),
(2), (4) Date: Oct. 29, 2010

(87) PCT Pub. No.: WO2009/134189

PCT Pub. Date: Nov. 5, 2009

(65) Prior Publication Data

US 2011/0129372 A1 Jun. 2, 2011

(30) Foreign Application Priority Data

May 2, 2008 (SE) ..... 0800988
May 27, 2008 (SE) ..... 0801240

(51) Int. Cl.
*F04B 49/00* (2006.01)

(52) U.S. Cl.
USPC ..... 417/63; 417/53; 417/431.1; 310/29

(58) Field of Classification Search
USPC ..... 417/53, 63, 413.1, 44.1, 44.9; 310/29
See application file for complete search history.

(56) References Cited

U.S. PATENT DOCUMENTS

| | | | | |
|---|---|---|---|---|
| 4,781,535 | A | 11/1988 | Frawley et al. | |
| 5,201,641 | A * | 4/1993 | Richer | 417/417 |
| 7,819,642 | B2 * | 10/2010 | Zabar | 417/413.1 |
| 8,272,850 | B2 * | 9/2012 | Stenberg | 417/413.1 |
| 2002/0094285 | A1 * | 7/2002 | Paolini et al. | 417/413.1 |

FOREIGN PATENT DOCUMENTS

| | | |
|---|---|---|
| GB | 1039145 | 8/1966 |
| WO | 2007/055642 | 5/2007 |
| WO | WO 2007055642 A1 * | 5/2007 |

OTHER PUBLICATIONS

Marie Tieck and Greg Carman, "Design and Characterization of a Novel Piezoelectric Hydraulic Pump", NASA GSRP Program, Sep. 2002.*

MKIV, 12 Volt Fuel pump MOD; http://web.archive.org/web/20070605014724/http://mkiv.comtecharticles/12v_mod/12v_mod.htm; dated Jun. 5, 2007.*

* cited by examiner

*Primary Examiner* — Nathan Zollinger
(74) *Attorney, Agent, or Firm* — Dilworth & Barrese, LLP.

(57) ABSTRACT

A membrane pump (1) for pumping a medium has a pump housing (2), a membrane (3) mounted to the pump housing and delimiting a pump chamber (4) inside the pump housing (2) and an actuating device for moving the membrane (3) to and fro to expand and contract the pump chamber (4). In a first operating mode, the actuating device moves the membrane (3) in a frequency suitable for pumping the medium into and out of the pump chamber (4), and in a second operating mode, the actuating device moves the membrane (3) in a frequency in the audible frequency region.

14 Claims, 1 Drawing Sheet

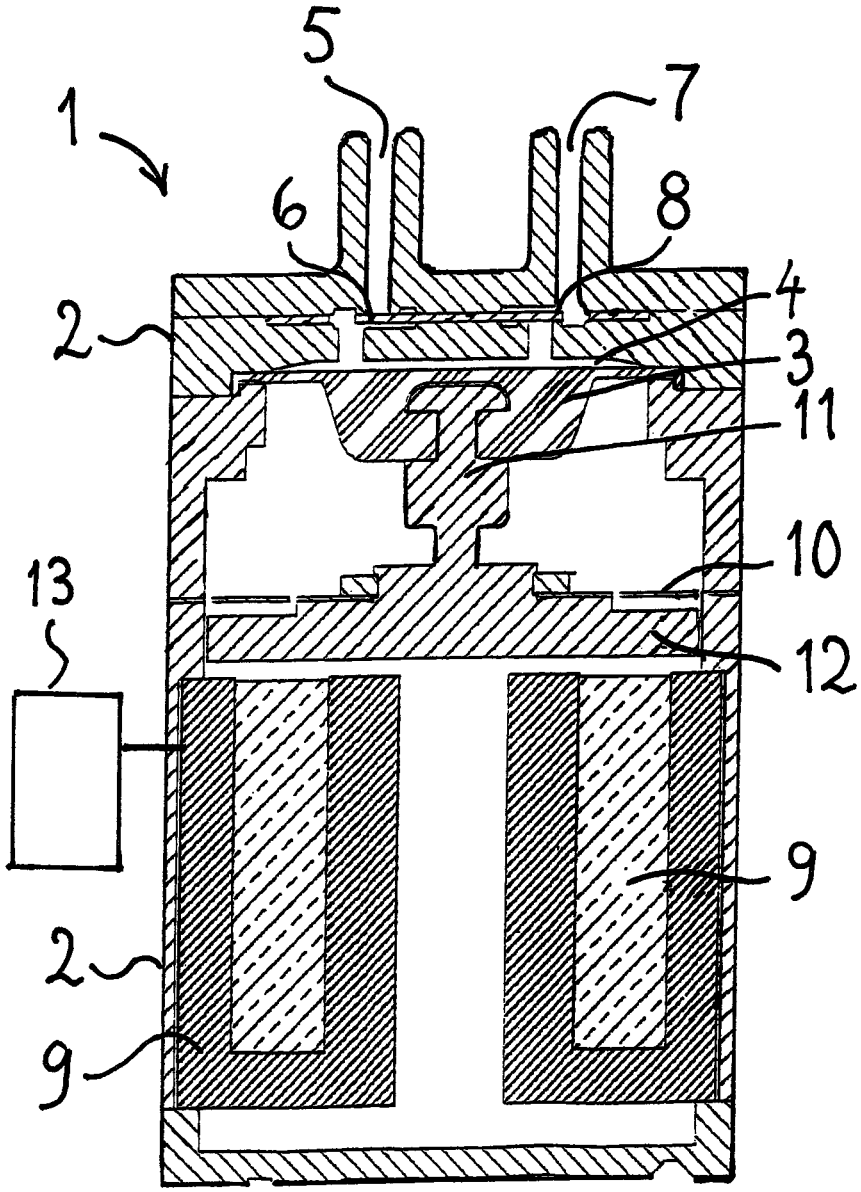
1
2
2
3
4
5
6
7
8
9
9
10
11
12
13

MEMBRANE PUMP OPERATING IN BOTH AUDIBLE AND INAUDIBLE FREQUENCY REGIONS

FIELD OF THE INVENTION AND PRIOR ART

The invention relates to a pumping system and method of producing a sound according to the description herein.

Membrane pumps that apply negative or positive pressure are found in a large variety of forms and sizes and are used in many different applications, from large industry pumps to small pumps for medical purposes. What they all have in common is that the flow and pressure created by the pumps are induced by the oscillations of a membrane. The membrane can for instance be brought to oscillation by electromagnetic means alone or electromagnetic means in combination with a spring.

One important aspect of pumping systems in general, and also of pumping systems using membrane pumps, is to have an arrangement in the pumping system for indicating operational disturbances. The operational disturbances can for instance be internal leakage, mechanical or software related failures etc. A suitable way to indicate operational disturbances could be the use of audible sound, such as sound generating means in an alarm system connected to the pumping system.

Usually, sound generating means are arranged separately from the pump, as described in U.S. Pat. No. 4,781,535 A, where an alarm system indicates failures in the membrane of a membrane pump. An alarm system arranged separately from the pump adds more bulk to the pump system, which can be a disadvantage in miniaturized pumping systems. Of course an additional implement adds costs to the overall production cost of the pumping system as well.

SUMMARY OF THE INVENTION

The object of the present invention is to provide a new and favourable manner of producing a sound in a pumping system in a simple and reliable manner.

This object is according to the invention achieved by a pumping system and method having the features defined herein.

According to the invention:

- the membrane pump comprises actuating means for moving the membrane to and fro in order to expand and contract a pump chamber, and
- the actuating means are adapted to operate, in a first operating mode, to move the membrane in a frequency suitable for pumping a medium into and out of the pump chamber, and in a second operating mode, to move the membrane in a frequency in the audible frequency region.

In case of operational disturbance, for instance internal leakage in the pump, pressure drops or peaks in a vessel connected to the inlet or outlet of the membrane pump etc, indicated by detection means, the pumping system can be switched from the first operating mode, which is a pumping mode, to the second operating mode, which is a sound generating mode. By this an operator or user is alerted and the operational disturbance can be evaluated. The sound generation from the pumping system is of course not limited to be used for indicating operational disturbances, but can be used for any other purpose when sound generation is desired.

According to an embodiment of the present invention, the frequency in the second operating mode is in the range of 20-5000 Hz, preferably 100-2000 Hz, most preferred 100-1500 Hz. The frequency range of 20-5000 Hz is within the audible frequency region for humans.

According to another embodiment of the present invention, the actuating means comprise an electromagnet in order to move the membrane in one direction. An electromagnet can easily be controlled by an electronic control unit and the force provided by the electromagnet can be adjusted accurately. Also, the speed by which the membrane is moved from one position to the other can easily be controlled when using an electromagnet as actuating means.

According to another embodiment of the invention, the actuating means comprise a flat spring. The membrane of the pumping system is moved in a first direction by other actuating means, for instance an electromagnet, requiring external energy in the form of for instance electricity. A flat spring is extended during the movement of the membrane in the first direction and the force moving the membrane in the first direction builds up a tension in the flat spring. When releasing the force moving the membrane in the first direction, e.g. by switching off the electromagnet, the action of the flat spring will move the membrane in the opposite direction. A flat spring does not require any external energy in the form of for instance electricity and is also suitable for moving the membrane in frequencies in the audible region.

According to another embodiment of the invention, the non-return valves are arranged not to open during operation of the actuating means in the second operating mode when the actuating means move the membrane in the audible frequency region. Hereby, a negative or positive pressure in a vessel connected to the inlet or the outlet of the pump chamber is not affected when the pumping system operates in the second operating mode.

The invention also relates to a method of producing a sound in a pumping system, the pumping system comprising a membrane pump for pumping a medium, the membrane pump comprising:

- a pump housing,
- a membrane, which is mounted to the pump housing and delimits a pump chamber inside the pump housing,
- an inlet for feeding medium into the pump chamber, the inlet having a first non-return valve connected thereto,
- an outlet for discharging medium from the pump chamber, the outlet having a second non-return valve connected thereto, and
- actuating means for moving the membrane to and fro in order to expand and contract the pump chamber, wherein the membrane is made to produce a sound by being moved in a frequency in the audible frequency region by the actuating means.

Other advantages and advantageous features of the invention will appear from the subsequent description.

BRIEF DESCRIPTION OF THE DRAWINGS

With reference to the appended drawings, below follows a specific description of embodiments of the invention cited as examples.

In the drawings:

FIG. 1 shows a pumping system according to the invention.

DETAILED DESCRIPTION OF PREFERRED EMBODIMENTS OF THE INVENTION

Explained herein are preferred embodiments of the invention, describing the pumping system of the invention and the method of producing a sound. The invention may, however, be embodied in many different forms and should not be construed as being limited to the exemplary embodiments set forth herein; rather, these embodiments are provided so that this disclosure will be thorough and complete, and will fully convey the concept of the invention to those skilled in the art.

A pumping system according to the invention is very schematically shown in FIG. 1. The pumping system comprises a membrane pump 1 comprising a pump housing 2 to which a membrane 3 is mounted. The membrane 3 delimits a pump chamber 4 inside the pump housing 2. The pump chamber 4 has an inlet 5 for feeding medium into the pump chamber 4 and a first non-return valve 6 is located between said inlet 5 and said pump chamber 4. The pump chamber 4 also has an outlet 7 for discharging medium out of the pump chamber 4 and a second non-return valve 8 is located between the outlet 7 and the pump chamber 4. An axle 11 which has a protruding part 12 comprising a magnetic material is attached to the membrane 3. A flat spring 10 is attached to the axle 11, the spring connecting the axle 11 with the pump housing 2. One side of the protruding part 12 of the axle 11 is facing an actuating member in the form of an electromagnet 9; an opposite side of the protruding part 12 of the axle 11 is also facing the pump chamber 4.

The electromagnet 9 is connected to an electronic control unit 13, which is adapted to control the supply of electric energy to the electromagnet 9 so as to thereby control the movements of the membrane 3.

In a first operating mode the membrane 3 of the membrane pump 1 of the pumping system is moved to and fro in frequencies suitable for pumping. During pumping using the pumping system shown in FIG. 1, in a first phase the flat spring 10 affects the axle 11, and thereby the membrane 3, with a force pulling the membrane 3 in a direction away from the pump chamber 4, whereby the volume of the pump chamber 4 expands and the first non-return valve 6 is opened so to allow medium to flow into the pump chamber 4. During this first phase, the membrane 3 is moved under the action of the spring 10 from one end position, here denominated second end position, to another end position, here denominated first end position. In a second phase the electromagnet 9 is activated, whereby the electromagnet 9 repels the protruding part 12 of the axle 11 and the axle 11 is pushed in a direction towards the pump chamber 4, and the membrane 3 consequently also moves towards the pump chamber 4. The pump chamber 4 is thereby contracted and the medium flows out from the pump chamber 4 through the second non-return valve 8 and the outlet 7. During this second phase, the membrane 3 is moved under the action of the electromagnet 9 and against the action of the spring 10 from the first end position to the second end position.

In a second operating mode the membrane 3 of the membrane pump 1 of the pumping system is moved to and fro in frequencies in the audible frequency region. The movements of the membrane 3 are induced by the electromagnet 9 and the spring 10 similarly as described above, but here the time for the first and the second phase is much shorter, i.e. the electromagnet 9 is activated during a shorter time. When the vibrations of the membrane 3 to and fro are fast, the non-return valves 6, 8 are arranged not to open. During fast vibration of the membrane 3 the distance between the end positions of the membrane 3 is small; hence the volume difference in the pump chamber 4 is small when comparing the volume of the pump chamber 4 when expanded and when contracted. The non-return valves 6, 8 are arranged to open when the pressure difference between the inlet side and the outlet side of the non-return valve 6, 8 reaches a certain value. Small volume changes in the pump chamber 4 during fast vibration of the membrane 3 result in small pressure changes in the pump chamber 4 when comparing the pressure in the pump chamber 4 when expended and the pressure in the pump chamber 4 when contracted. The non-return valves 6, 8 of the present invention are arranged so as to not open by the pressure difference created when pumping in the audible frequency or higher.

The pumping system of the invention may be used for producing a negative pressure in a vessel connected to the inlet 5 of the pump chamber 4 or a positive pressure in a vessel connected to the outlet 7 of the pump chamber 4.

As a further alternative, the actuating means can comprise a first electromagnet for moving the membrane 3 in a first direction and a second electromagnet for moving the membrane 3 in the opposite direction. The actuating means can also comprise other types of actuating members for moving the membrane, such as for instance piezoelectric members. In the latter case, the membrane 3 can comprise piezoelectric material by itself or have a piezoelectric actuating member connected to it.

The invention is of course not in any way limited to the embodiments described above. On the contrary, several possibilities to modifications thereof should be apparent to a person skilled in the art without departing from the basic idea of the invention as defined in the appended claims.

The invention claimed is:

1. A pumping system comprising a membrane pump (1) for pumping a medium, the membrane pump (1) comprising:

a pump housing (2), a membrane (3), which is mounted to the pump housing (2) and delimits a pump chamber (4) inside the pump housing (2), an inlet (5) for feeding medium into the pump chamber (4), the inlet (5) having a first non-return valve (6) connected thereto, an outlet (7) for discharging medium from the pump chamber (4), the outlet (7) having a second non-return valve (8) connected thereto, an axle (11) attached to the membrane (3), an actuating electromagnet (9) for moving the axle (11) and membrane (3) to and fro to expand and contract the pump chamber (4), wherein the actuating electromagnet (9) is arranged to operate in two separate and distinct operating modes, in a first operating mode moving the membrane (3) in an inaudible frequency suitable for pumping a medium into and out of the pump chamber (4), and in a second operating mode moving the membrane (3) in a frequency in an audible frequency region for generating an audible alarm, and a control unit for increasing the frequency by activation and deactivation of the electromagnet (9) to increase vibration frequency of the membrane (3) to vibrate in the second operating mode where response time of the oscillating membrane (3) results in a smaller oscillation amplitude of the membrane (3) and the non-return valves (6, 8) are unaffected by the membrane (3) oscillation and thus prevented from opening and closing.

2. A pumping system according to claim 1, wherein the frequency in the second operating mode is in the range of 20-5000 Hz.

3. A pumping system according to claim 1, additionally comprising a flat spring (10) attached to the axle (11) and connected with the pump housing (2).

4. A pumping system according to claim 2, additionally comprising a flat spring (10) attached to the axle (11) and connected with the pump housing (2).

5. A pumping system according to claim 2, wherein the frequency in the second operating mode is in the range of 100-2000 Hz.

6. A pumping system according to claim 5, wherein the frequency in the second operating mode is in the range of 100-1500 Hz.

7. A pumping system according to claim 1, additionally comprising a spring (10) attached to the axle (11) and connected with the pump housing (2), and said electromagnet (9) facing an end (12) of the axle (11), with the spring (10) positioned between the electromagnet (9) and membrane (3).

8. A pumping system according to claim 7, wherein the spring (10) and electromagnet (9) are arranged to bias the axle (11) and membrane (3) in opposite directions.

9. A pumping system according to claim 7, wherein the axle (11) has a radially-protruding part (12) having magnetic material and positioned between the spring (10) and electromagnet (9).

10. A pumping system according to claim 1, wherein the inaudible frequency range is below the audible frequency range.

11. Method of producing a sound in a pumping system, the pumping system comprising a membrane pump (1) for pumping a medium into or out of a vessel, the membrane pump (1) comprising:

a pump housing (2), a membrane (3), which is mounted to the pump housing (2) and delimits a pump chamber (4) inside the pump housing (2), an inlet (5) for feeding medium into the pump chamber (4), the inlet (5) having a first non-return valve (6) connected thereto, an outlet (7) for discharging medium from the pump chamber (4), the outlet (7) having a second non-return valve (8) connected thereto, an actuating electromagnet (9) for moving the axle (11) and membrane (3) to and fro to expand and contract the pump chamber, wherein the actuating electromagnet (9) operates in two separate and distinct operating modes, in a first operating mode moving the membrane (3) in an inaudible frequency suitable for pumping a medium into and out of the pump chamber (4), and in a second operating mode moving the membrane (3) in a frequency in an audible frequency region for generating an audible alarm, and a control unit for increasing the frequency by activation and deactivation of the electromagnet (9) to increase vibration frequency of the membrane (3) to vibrate in the second operating mode where response time of the oscillating membrane (3) results in a smaller oscillation amplitude of the membrane (3) and the non-return valves (6, 8) are unaffected by the membrane (3) oscillation and thus prevented from opening and closing, and the membrane (3) produces a sound by being moved in the frequency in the audible frequency region by the actuating electromagnet (9).

12. The method according to claim 11, wherein the pumping system additionally comprises a flat spring (10) attached to the axle (11) and connected with the pump housing (2).

13. The method according to claim 11, wherein the inaudible frequency range is below the audible frequency range.

14. The method according to claim 11, wherein said pumping system additionally comprises a spring (10) attached to the axle (11) and connected with the pump housing (2), and said electromagnet (9) facing an end (12) of the axle (11), with the spring (10) positioned between the electromagnet (9) and membrane (3).

* * * * *